US007484653B2

(12) United States Patent
Hurtado et al.

(10) Patent No.: US 7,484,653 B2
(45) Date of Patent: Feb. 3, 2009

(54) CUP HOLDER TRAY

(75) Inventors: Jorge L. Hurtado, Plainfield, IL (US); Raymond Roman, Chicago, IL (US)

(73) Assignee: International Paper Co., Memphis, TN (US)

( * ) Notice: Subject to any disclaimer, the term of this patent is extended or adjusted under 35 U.S.C. 154(b) by 230 days.

(21) Appl. No.: 11/425,468

(22) Filed: Jun. 21, 2006

(65) Prior Publication Data

US 2007/0295788 A1 Dec. 27, 2007

(51) Int. Cl.
*B65D 25/04* (2006.01)

(52) U.S. Cl. ..... 229/120.14; 206/562; 229/904

(58) Field of Classification Search ..... 229/120.14, 229/904; 206/562, 563, 564, 565
See application file for complete search history.

(56) References Cited

U.S. PATENT DOCUMENTS 3,326,446 A * 6/1967 Goings ..... 206/563
3,400,875 A * 9/1968 Coe ..... 206/563
3,434,649 A * 3/1969 Goings ..... 206/561
3,434,650 A * 3/1969 Goings ..... 206/563
3,703,982 A * 11/1972 Daughtry ..... 229/904
3,722,781 A * 3/1973 Page et al. ..... 206/563
3,730,419 A * 5/1973 Botterman et al. ..... 206/563
3,899,119 A * 8/1975 Roccaforte ..... 206/562
5,205,474 A * 4/1993 Stuart et al. ..... 206/563
6,568,586 B1 5/2003 VanEsley et al.
7,293,695 B2 * 11/2007 Stier ..... 229/120.14
2004/0195144 A1 10/2004 Smith
2006/0042989 A1 3/2006 Suter

* cited by examiner

*Primary Examiner*—Gary E Elkins

(57) ABSTRACT

A tray having an L shaped upper wall, side panels attached to the sides of the upper wall, inner panels attached to the upper wall, locking tabs on the lower edges of the inner panels, and a bottom wall having locking apertures which accommodate the locking tabs.

7 Claims, 6 Drawing Sheets

CUP HOLDER TRAY

This application relates to a collapsible tray have compartments for beverage or dip cups.

Figure 1:
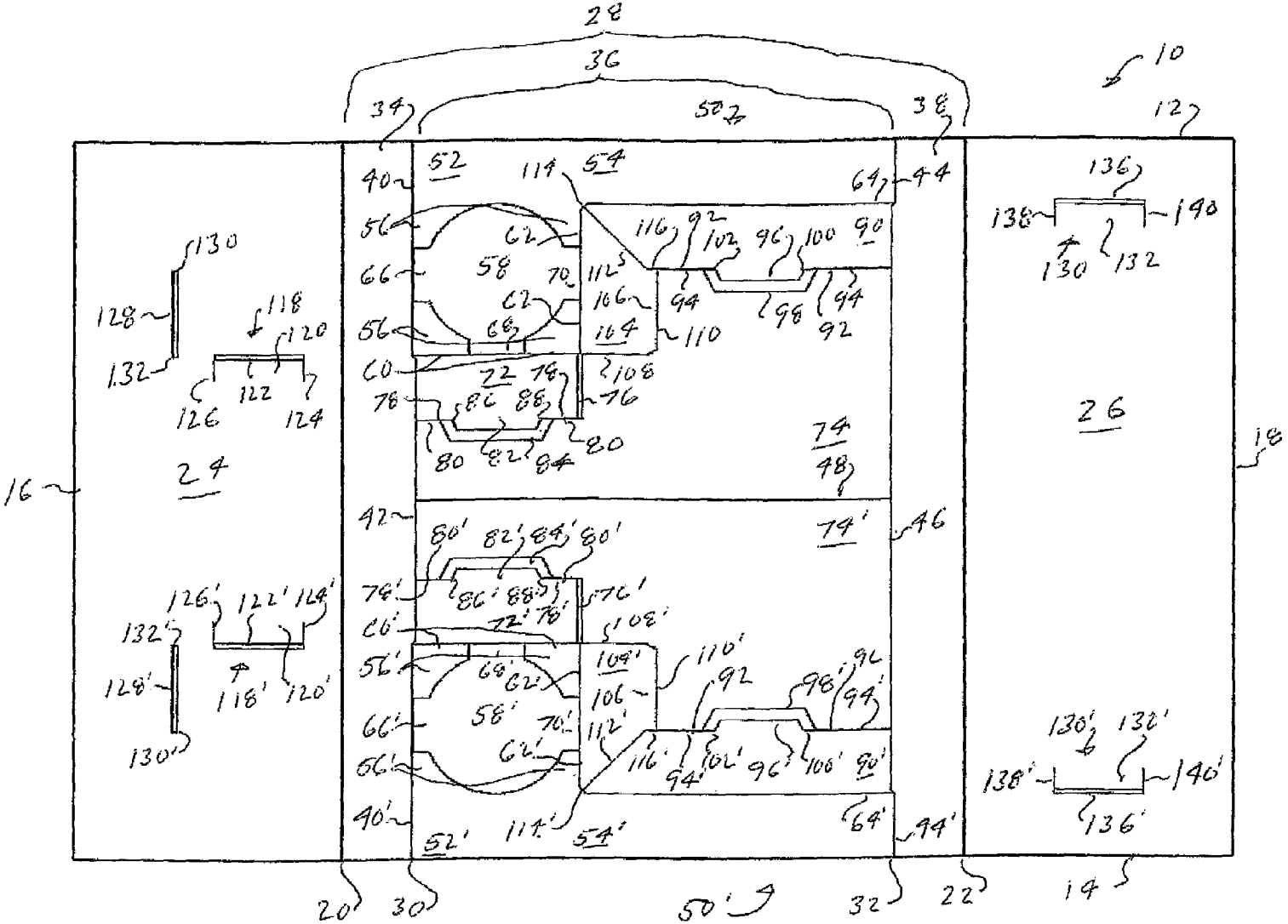
FIG. 1 is a top plan view of an embodiment of a blank for the tray.

The rectangular blank 10 has longitudinal side edges 12 and 14 and transverse end edges 16 and 18. The side edges are substantially perpendicular to the end edges. The blank 10 is divided by transverse score lines 20 and 22 into bottom wall elements 24 and 26 and an upper element 28.

The upper element 28 is divided by transverse lines 30 and 32 into a first side panel 34' and upper section 36 and a second side panel 38. Transverse score line 30 is formed by substantially aligned transverse score lines 40 and 40' and slit or perforation 42 extending between score lines 40 and 40'. Transverse line 32 is formed by substantially aligned transverse score lines 44 and 44' and slit or perforation 46 extending between score lines 44 and 44'.

The end edges 16 and 18, the score lines 20 and 22, and the transverse lines 30 and 32 are substantially parallel.

The height of first side panel 34 is the distance between the transverse score line 20 and the transverse line 30. The height of second side panel 38 is the distance between the transverse line 32 and the transverse score line 22.

The width of bottom wall element 24 is the distance between the transverse score line 20 and end edge 16. The width of bottom wall element 26 is the distance between the transverse line 22 and end edge 18. The combined width of the bottom wall elements 24 and 26 is greater that the distance between the transverse lines 30 and 32 to allow the bottom wall elements to overlap and be glued together. In this embodiment, the bottom wall is made up of two bottom wall elements and the glue joint is in the bottom wall.

A longitudinal slit or perforation 48 extending between slits or perforations 42 and 46 divides the upper section 36 into first upper member 50 and a second upper member 50'. The longitudinal slit 48 is substantially parallel to longitudinal edges 12 and 14 and substantially midway between the longitudinal edges 12 and 14.

The first upper member 50 has an L shaped upper wall 52 formed by a longitudinal narrow upper wall member 54 and a wall member extension 56 extending from one side of the wall member 54. There is a round cup aperture 58 in the upper wall 52. In the embodiment shown the aperture 58 is in the extension 56.

The upper wall 52 is defined by the transverse score line 40 which forms a first side edge, the longitudinal score line 60 which forms a first inner edge, the transverse score line 62 which forms a second inner edge, the longitudinal score line 64 which forms a third inner edge, the transverse score line 44 which forms a second side edge and the longitudinal edge 12 which forms an outer edge. The longitudinal score lines 60 and 64 are offset and are substantially parallel to the longitudinal side edges 12 and 14. The distance between longitudinal score line 60 and longitudinal edge 12 is greater than the distance between longitudinal score line 64 and longitudinal edge 12.

Longitudinal score line 60 extends inwardly into upper section 36 from the inner end of score line 40 opposite the longitudinal edge 12, and is substantially perpendicular to score line 40. Longitudinal score line 64 extends inwardly into upper section 36 from the inner end of score line 44 opposite the longitudinal edge 12 and is substantially perpendicular to score line 44. Transverse score line 62 is substantially parallel to end edges 16 and 18, and extends between the inner ends of longitudinal score lines 60 and 64.

There are cut-out sections 66, 68 and 70 extending between the aperture 58 and the score lines 40, 60 and 62 respectively. These cut-out sections allow the upper wall elements to grip the cup in the aperture 58.

The first inner panel 72 is attached to the upper wall extension 56 by score line 60. One side of first inner panel 72 is separated from first side panel 34 by slit 42, and the other side is separated from the inner bottom wall 74 by slit or cut line 76. Inner panel 72 has a bottom edge 78 which is spaced from and substantially parallel to score line 60. Part of the bottom edge 78 is formed by score line 80 which attaches the inner panel 72 to inner bottom wall 74. The height of the inner panel 72, the distance between score line 60 and bottom edge 78, is substantially equal to the height of side panels 34 and 38.

A locking tab 82 is formed centrally of first inner panel 72 and extends outwardly from the bottom edge 78. The locking tab 82 is separated from the inner bottom wall 74 by an aperture 84. The locking tab 82 has a first end 86 formed where one side of the locking tab 82 meets the bottom edge 78 of the first inner panel 72 and a second end 88 formed where the other side of the locking tab 82 meets the bottom edge 78 of the first inner panel 72. The first end 86 is near to side panel 38 and the second end 88 is spaced further from the side panel 38 than the first end 86. The length of locking tab 82 is defined by the distance between ends 86 and 88.

Third inner panel 90 is attached to the upper wall 52 by the score line 64, and is separated from second side panel 38 by slit 46. The third inner panel 90 has a bottom edge 92 which is spaced from and substantially parallel to the score line 64. Part of the bottom edge 92 is formed by score line 94 which attaches the third inner panel 90 to the inner bottom wall 74. The height of the third inner panel 90, the distance between score line 64 and bottom edge 92, is substantially equal to the height of side panels 34 and 38.

A locking tab 96 is formed centrally of third inner panel 90 and extends outwardly from the bottom edge 92. The locking tab 96 is separated from the inner bottom wall 74 by an aperture 98. The locking tab 96 has a first end 100 formed where one side of the tab 96 meets the bottom edge 92 of the third inner panel 90 and a second end 102 formed where the other side of the locking tab 96 meets the bottom edge 92. The first end 100 is spaced further from side panel 38 than the second end 102. The length of locking tab 96 is defined by the distance between ends 100 and 102.

Second inner panel 104 is attached to the upper wall extension 56 by score line 62, and has a locking tab 106 formed on its bottom end. The second inner panel 104 and its locking tab 106 are separated from the inner bottom wall 74 by slits or cut lines 108 and 110. The slits 108 and 110 are substantially perpendicular to each other, and the slit 110 and the score line 62 are substantially parallel.

The second inner panel 104 is separated from third inner panel 90 by diagonal slit 112. The diagonal slit 112 extends from the juncture 114 of score lines 62 and 64 to the bottom edge of third inner panel 90. The diagonal slit 112 is at a substantially 45° angle to the score lines 62 and 64. The height of the second inner panel 104, the distance perpendicular to score line 62 between score line 62 and the juncture of diagonal slit 112 and the bottom edge 92 of inner panel 90, is substantially equal to the height of the side panels 34 and 38.

The locking tab 106 is separated from the second inner panel 90 by a slit 116. The slit 116 extends between the end of diagonal slit 100 and the score line 94 and meets with slit 110. The slit 116 forms part of the bottom edge 92 of second inner panel 90 and is substantially perpendicular to slit 110. The slits 108, 110 and 116 define the locking tab 106. The locking tab 106 has a length defined by the distance between slits 108 and 116 and a height defined by the length of slit 116.

In the embodiment shown, the first and second upper members are substantially mirror images of each other and the same reference numerals will be used for the same elements in each member.

The second upper member 50' has an L shaped upper wall 52' formed by a longitudinal narrow upper wall member 54' and a wall member extension 56' extending from one side of the wall member 54'. There is a round cup aperture 58' in the upper wall 52'. In the embodiment shown the aperture 58' is in the extension 56'.

The upper wall 52' is defined by the transverse score line 40' which forms a first side edge, the longitudinal score line 60' which forms a first inner edge, the transverse score line 62' which forms a second inner edge, the longitudinal score line 64' which forms a third inner edge, the transverse score line 44' which forms a second side edge and the longitudinal edge 14 which forms an outer edge. The longitudinal score lines 60' and 64' are offset and are substantially parallel to the longitudinal side edges 12 and 14. The distance between longitudinal score line 60' and longitudinal edge 14 is greater than the distance between longitudinal score line 64' and longitudinal edge 14.

Longitudinal score line 60' extends inwardly into upper section 36 from the inner end of score line 40' opposite the longitudinal edge 14, and is substantially perpendicular to score line 40'. Longitudinal score line 64' extends inwardly into upper section 36 from the inner end of score line 44' opposite the longitudinal edge 14 and is substantially perpendicular to score line 44'. Transverse score line 62' is substantially parallel to end edges 16 and 18, and extends between the inner ends of longitudinal score lines 60' and 64'.

There are cut-out sections 66', 68' and 70' extending between the aperture 58' and the score lines 40', 60' and 62' respectively. These cut-out sections allow the upper wall elements to grip the cup in the aperture 58'.

The first inner panel 72' is attached to the upper wall extension 56' by score line 60'. One side of first inner panel 72' is separated from first side panel 34 by slit 42, and the other side is separated from the inner bottom wall 74' by slit or cut line 76'. First inner panel 72' has a bottom edge 78' which is spaced from and substantially parallel to score line 60'. Part of the bottom edge 78' is formed by score line 80' which attaches the first inner panel 72' to inner bottom wall 74'. The height of the first inner panel 72', the distance between score line 60' and bottom edge 78', is substantially equal to the height of side panels 34 and 38.

A locking tab 82' is formed centrally of first inner panel 72' and extends outwardly from the bottom edge 78'. The locking tab 82' is separated from the inner bottom wall 74' by an aperture 84'. The locking tab 82' has a first end 86' formed where one side of the locking tab 82' meets the bottom edge 78' of the first inner panel 72' and a second end 88' formed where the other side of the locking tab 82' meets the bottom edge 78' of the first inner panel 72'. The first end 86' is near to side panel 38 and the second end 88' is spaced further from the side panel 38 than the first end 86'. The length of locking tab 82' is defined by the distance between ends 86' and 88'.

Third inner panel 90' is attached to the upper wall 52' by the score line 64', and is separated from second side panel 38 by slit 46. The third inner panel 90' has a bottom edge 92' which is spaced from and substantially parallel to the score line 64'. Part of the bottom edge 92' is formed by score line 94' which attaches the third inner panel 90' to the inner bottom wall 74'. The height of the third inner panel 90', the distance between score line 64' and bottom edge 92', is substantially equal to the height of side panels 34 and 38.

A locking tab 96' is formed centrally of third inner panel 90' and extends outwardly from the bottom edge 92'. The locking tab 96' is separated from the inner bottom wall 74' by an aperture 98'. The locking tab 96' has a first end 100' formed at the juncture of one side of the tab 96' and the bottom edge 92' of the third inner panel 90' and a second end 102' formed at the juncture of the other side of the locking tab 96' and the bottom edge 92'. The first end 100' is spaced further from side panel 38 than the second end 102'. The length of locking tab 96' is defined by the distance between ends 100' and 102'.

Second inner panel 104' is attached to the upper wall extension 56' by score line 62', and has a locking tab 106' formed on its bottom end. The second inner panel 104' and its locking tab 106' are separated from the inner bottom wall 74' by slits or cut lines 108' and 110'. The slits 108' and 110' are substantially perpendicular to each other, and the slit 110' and the score line 62' are substantially parallel.

The second inner panel 104' is separated from third inner panel 90' by diagonal slit 112'. The diagonal slit 112' extends from the juncture 114' of score lines 62' and 64' to the bottom edge of third inner panel 90'. The diagonal slit 112' is at a substantially 45° angle to the score lines 62' and 64'. The height of the second inner panel 104', the distance perpendicular to score line 62' between score line 62' and the juncture of diagonal slit 112' and the bottom edge 92' of third inner panel 90', is substantially equal to the height of the side panels 34 and 38.

The locking tab 106' is separated from the third inner panel 90' by a slit 116'. The slit 116' extends between the end of diagonal slit 100' and the score line 94' and meets with slit 110'. The slit 116' forms part of the bottom edge 92' of third inner panel 90' and is substantially perpendicular to slit 110'. The slits 108', 110' and 116' define the locking tab 106'. The locking tab 106' has a length defined by the distance between slits 108' and 116' and a height defined by the length of slit 116'.

In FIG. 1, the bottom wall is formed by bottom wall elements 24 and 26.

Bottom wall element 24 has a pair of locking apertures at each end.

One of the locking apertures, first locking aperture 118, is for locking tab 82 on first inner panel 72. The aperture 118 may be a standard aperture, or, as shown, be formed by U-shaped slits to form a securing tab 120. The U-shaped slit is formed by longitudinal slit 122 having a transverse slit 124 at one end and a transverse slit 126 at the other end. The longitudinal slit 122 is substantially aligned with score line 60. Transverse slit 124 is spaced from transverse score line 20 a distance that is equal to or slightly less than the distance between transverse line 30 and first side end 86 of locking tab 82. The distance between transverse slits 124 and 126 is equal to or slightly greater than the distance between the ends 86 and 88 of locking tab 82 to allow the locking tab 82 to extend through the locking aperture 118 in the formed tray. The slits 122, 124 and 126 form the securing tab 120 which pushes against and secures locking tab 82 in the formed tray. In the embodiment shown the transverse slits 124 and 126 extend inwardly from longitudinal slit 122 away from longitudinal side edge 12. They may also extend toward the side edge 12 instead of away from the side edge. In either direction they form the securing tab.

If there is no securing tab 120 then the aperture 118 would be formed by a second longitudinal line parallel to longitudinal slit 122 extending between the transverse slits 124 and 126 to form an aperture. The spacing of transverse slit 124 from transverse score line 20 and the distance between transverse score lines 124 and 126 would be the same as described above.

The second of the pair of locking apertures, second locking aperture 128 is for locking tab 110 on second inner panel 104. Second locking aperture 128 is substantially parallel to score lines 20 and 62, and is spaced from score line 20 a distance that is substantially equal to the distance between transverse line 30 and score line 62. The length of locking aperture 128, defined by the distance between its ends 130 and 132 is substantially equal to or greater than the length of locking tab 110. The locking aperture 128 is aligned with locking tab 110 so that the locking tab 110 will lock within locking aperture 128 when the tray is erected.

Locking apertures 118' and 128' are at the other end of bottom wall element 24. The are the same as locking apertures 118 and 128 and the same reference numerals will be used.

One of the locking apertures, first locking aperture 118', is for locking tab 82' on first inner panel 72'. The aperture 118' may be a standard aperture, or, as shown, be formed by U-shaped slits to form a securing tab 120'. The U-shaped slit 118' is formed by longitudinal slit 122' having a transverse slit 124' at one end and a transverse slit 126' at the other end. The longitudinal slit 122' is substantially aligned with score line 60'. Transverse slit 124' is spaced from transverse score line 20 a distance that is equal to or slightly less than the distance between transverse line 30 and first side end 86' of locking tab 82'. The distance between transverse slits 124' and 126' is equal to or slightly greater than the distance between the ends 86' and 88' of locking tab 82' to allow the locking tab 82' to extend through the locking aperture 118' in the formed tray. The slits 122', 124' and 126' form the securing tab 120' which pushes against and secures locking tab 82' in the formed tray. In the embodiment shown the transverse slits 124' and 126' extend inwardly from longitudinal slit 122' away from longitudinal side edge 14. They may also extend toward the side edge 14 instead of away from the side edge. In either direction they form the securing tab.

If there is no securing tab 120' then the aperture 118' would be formed by a second longitudinal line parallel to longitudinal slit 122' extending between the transverse slits 124' and 126' to form an aperture. The spacing of transverse slit 124' from transverse score line 20 and the distance between transverse score lines 124' and 126' would be the same as described in the preceding paragraph.

The second of the pair of locking apertures, second locking aperture 128' is substantially parallel to score lines 20 and 62', and is spaced from score line 20 a distance that is substantially equal to the distance between transverse line 30 and score line 62'. The length of locking aperture 128', defined by the distance between its ends 130' and 132' is substantially equal to or greater than the length of locking tab 110'. The locking aperture 128' is aligned with locking tab 110' so that the locking tab 110' will lock within locking aperture 128' when the tray is erected.

Bottom wall element 26 has a pair of third locking apertures 130 and 130'. The apertures 130 and 130' may be standard apertures, or, as shown, be formed by U-shaped slits to form a locking tab.

One of the locking apertures, third locking aperture 130, is for locking tab 96 on third inner panel 90. The aperture 130 may be a standard aperture, or, as shown, be formed by U-shaped slits to form a securing tab 132. The U-shaped slit is formed by longitudinal slit 136 having a transverse slit 138 at one end and a transverse slit 140 at the other end. The longitudinal slit 136 is aligned substantially with score line 64. Transverse slit 138 is spaced from transverse score line 22 a distance that is equal to or slightly less than the distance between transverse line 32 and first side end 100 of locking tab 96. The distance between transverse slits 138 and 140 is equal to or slightly greater than the distance between the ends 100 and 102 of locking tab 96 to allow the locking tab 96 to extend through the locking aperture 130 in the formed tray. The slits 120, 122 and 124 form a securing tab 132 which pushes against locking tab 96 in the formed tray. In the embodiment shown the transverse slits 138 and 140 extend inwardly from longitudinal slit 136 away from longitudinal side edge 12. They may also extend toward the side edge 12 instead of away from the side edge. In either direction they form the securing tab.

The other third locking aperture 130' is similarly formed and similarly aligned with score line 64' and locking tab 96'. The same reference numerals have been used.

Third locking aperture 130', is for locking tab 96' on third inner panel 90'. The aperture 130' may be a standard aperture, or, as shown, be formed by U-shaped slits to form a securing tab 132'. The U-shaped slit 134' is formed by longitudinal slit 136' having a transverse slit 138' at one end and a transverse slit 140' at the other end. The longitudinal slit 136' is aligned substantially with score line 64'. Transverse slit 138' is spaced from transverse score line 22 a distance that is equal to or slightly less than the distance between transverse line 32 and first side end 100' of locking tab 96'. The distance between transverse slits 138' and 140' is equal to or slightly greater than the distance between the ends 100' and 102' of locking tab 96' to allow the locking tab 96' to extend through the locking aperture 130' in the formed tray. The slits 120', 122' and 124' form a securing tab 132' which pushes against locking tab 96' in the formed tray. In the embodiment shown the transverse slits 138' and 140' extend inwardly from longitudinal slit 136' away from longitudinal side edge 14. They may also extend toward the side edge 14 instead of away from the side edge. In either direction they form the securing tab.

Figure 2:
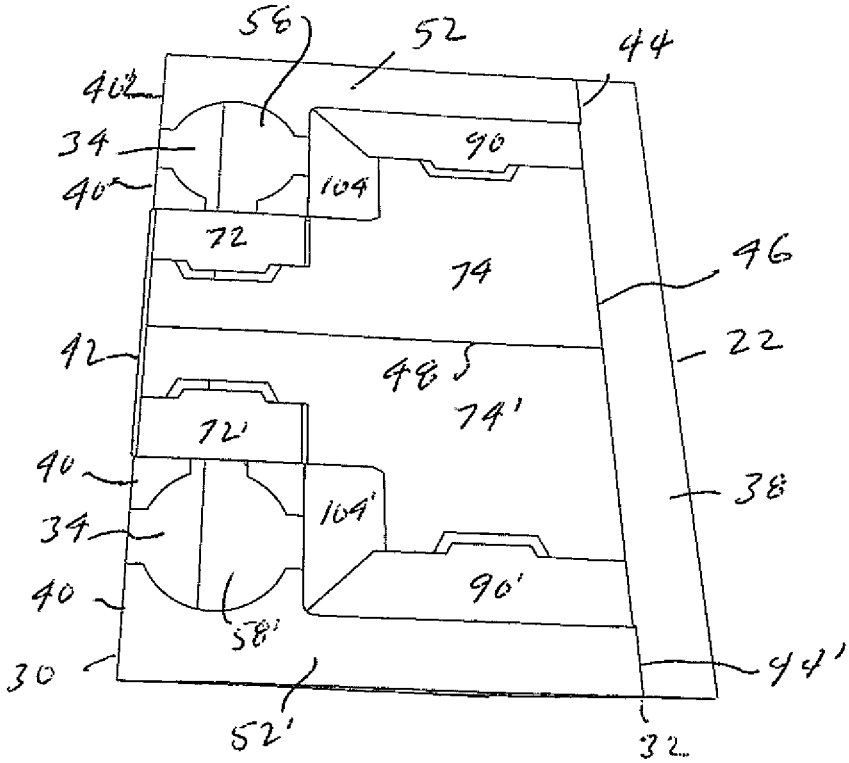
FIG. 2 is an isometric top view of the glued blank for the embodiment.
Figure 3:
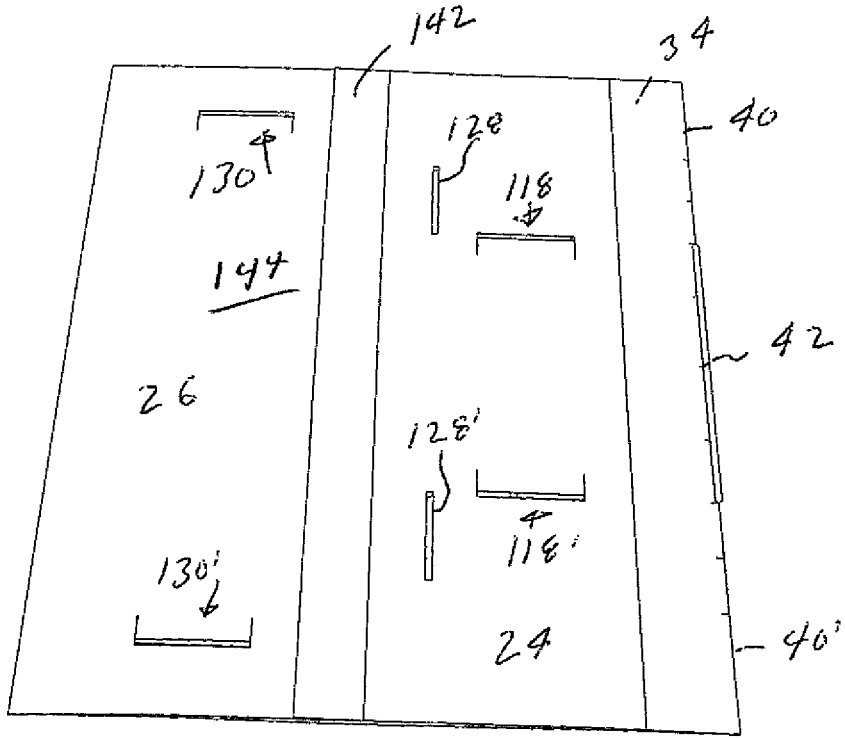
FIG. 3 is an isometric bottom view of the glued blank for the embodiment.

In forming the glued lay-flat tray the blank 10 is folded either around transverse score line 20 and transverse line 32 or around transverse line 30 and transverse score line 22 to allow the bottom wall elements 24 and 26 to overlap and be glued together in the overlap section 142 to form the bottom wall 144. Glue is applied to the one or both of the bottom wall elements 24 and 26 in the overlap section prior to joining the elements together. The glued lay-flat tray is shown in FIGS. 2 and 3. The lay-flat tray of FIG. 2 is rotated around transverse line 30 to provide the view of FIG. 3.

Figure 4:
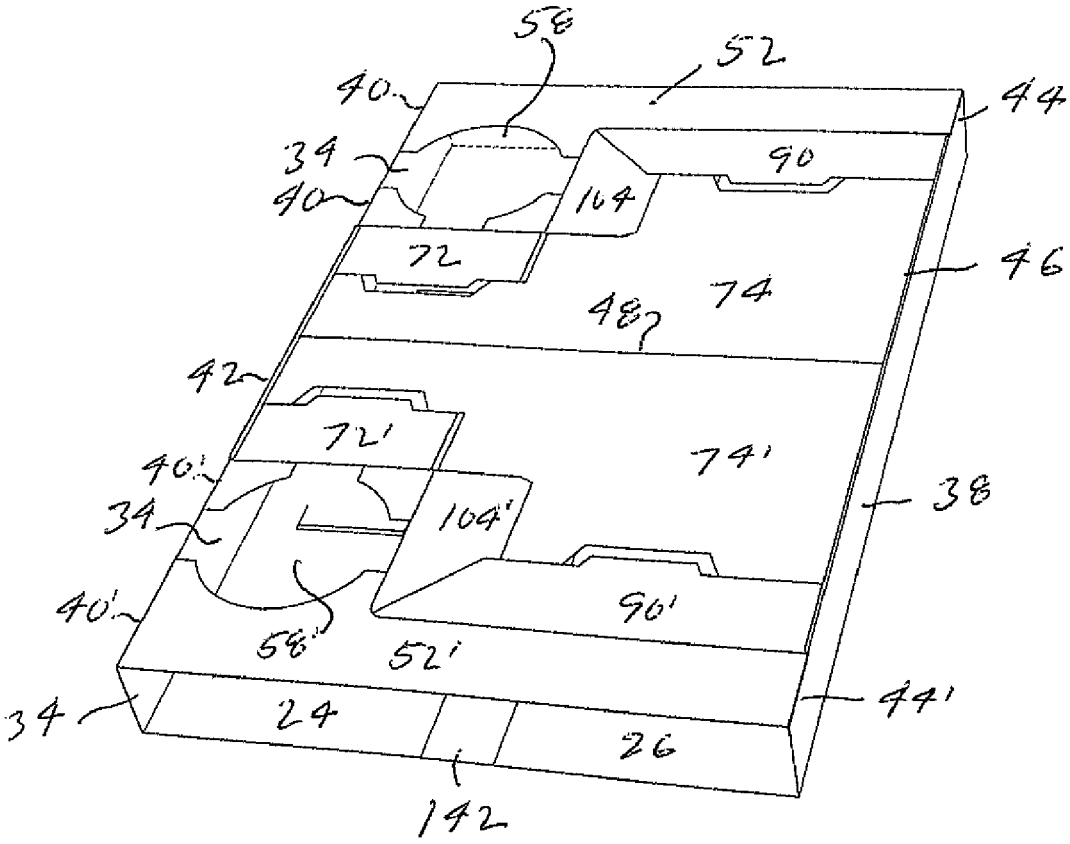
FIGS. 4-6 are isometric views of the glued blank of FIGS. 2-3 being formed into a tray.
Figure 5:
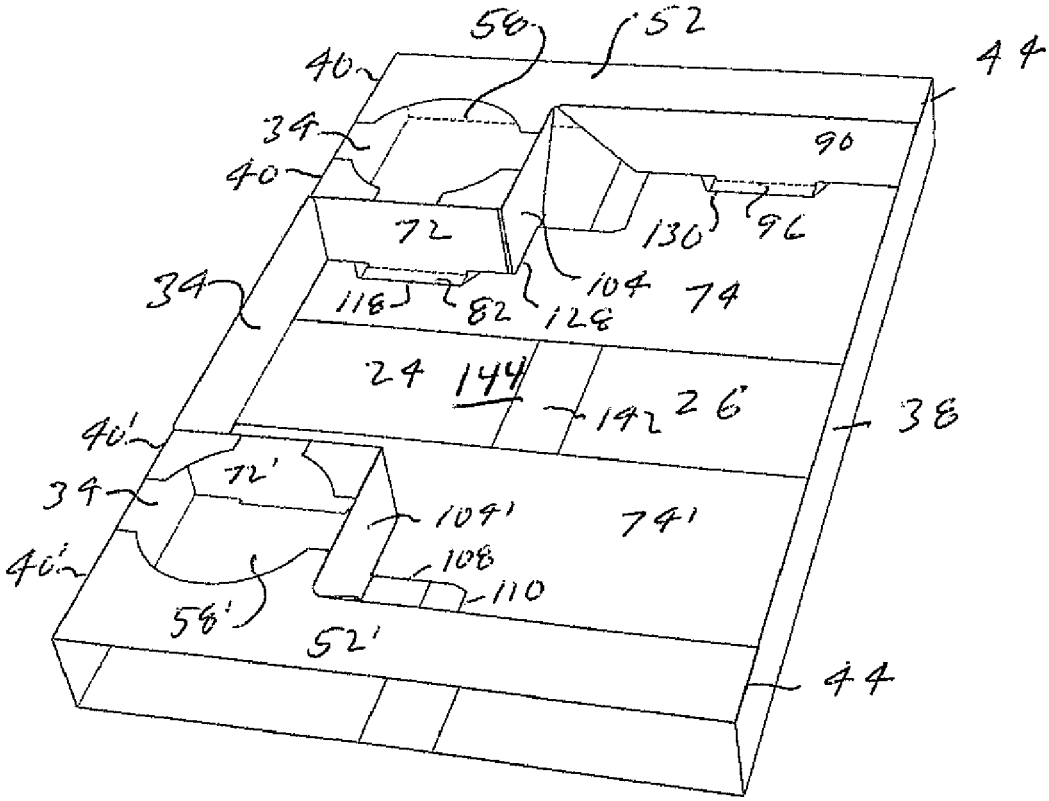
Figure 6:
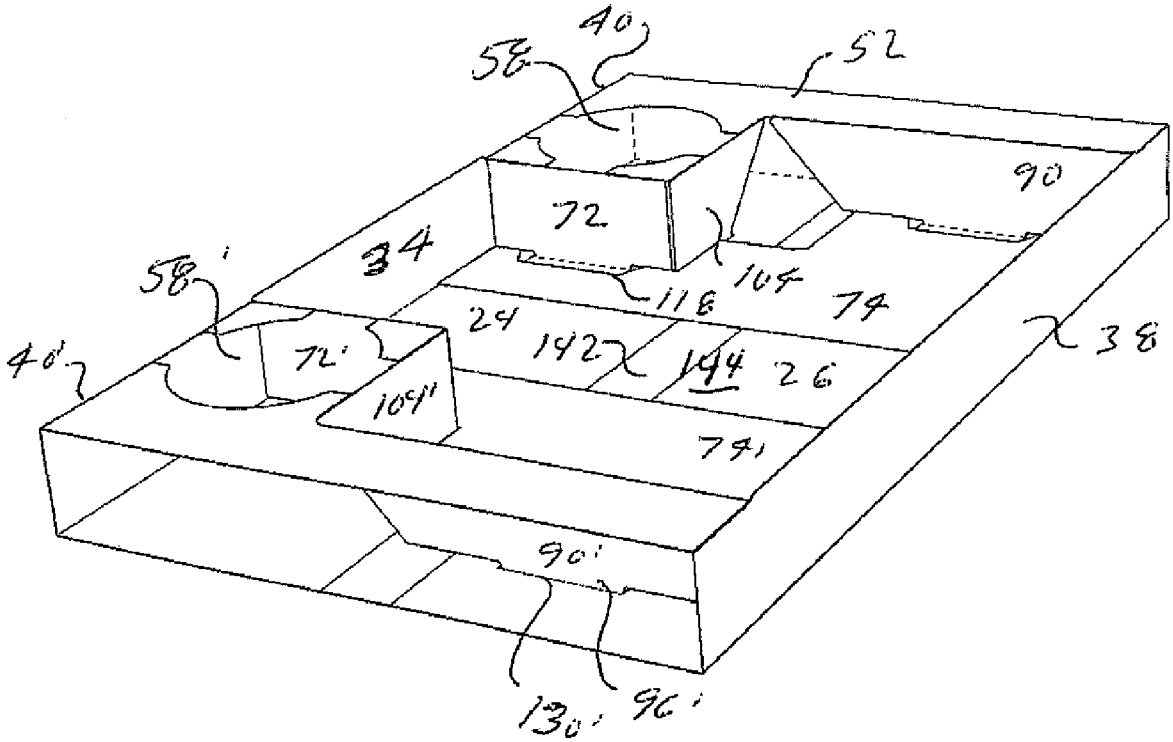

The tray is erected as shown in FIGS. 4-6. The side walls 34 and 38 are rotated upwardly until they are substantially perpendicular to the bottom wall 144. The inner panels are rotated downwardly and the locking tabs on the inner panels are inserted in their respective locking apertures. The rotation of the first and third inner wall panels into an upright position draws the inner bottom walls away from each other as they rotate around the score lines that attach the first and third inner wall panels to the inner bottom wall. The apertures 58 and 58' may be used for drink or dip cups.

Figure 7:
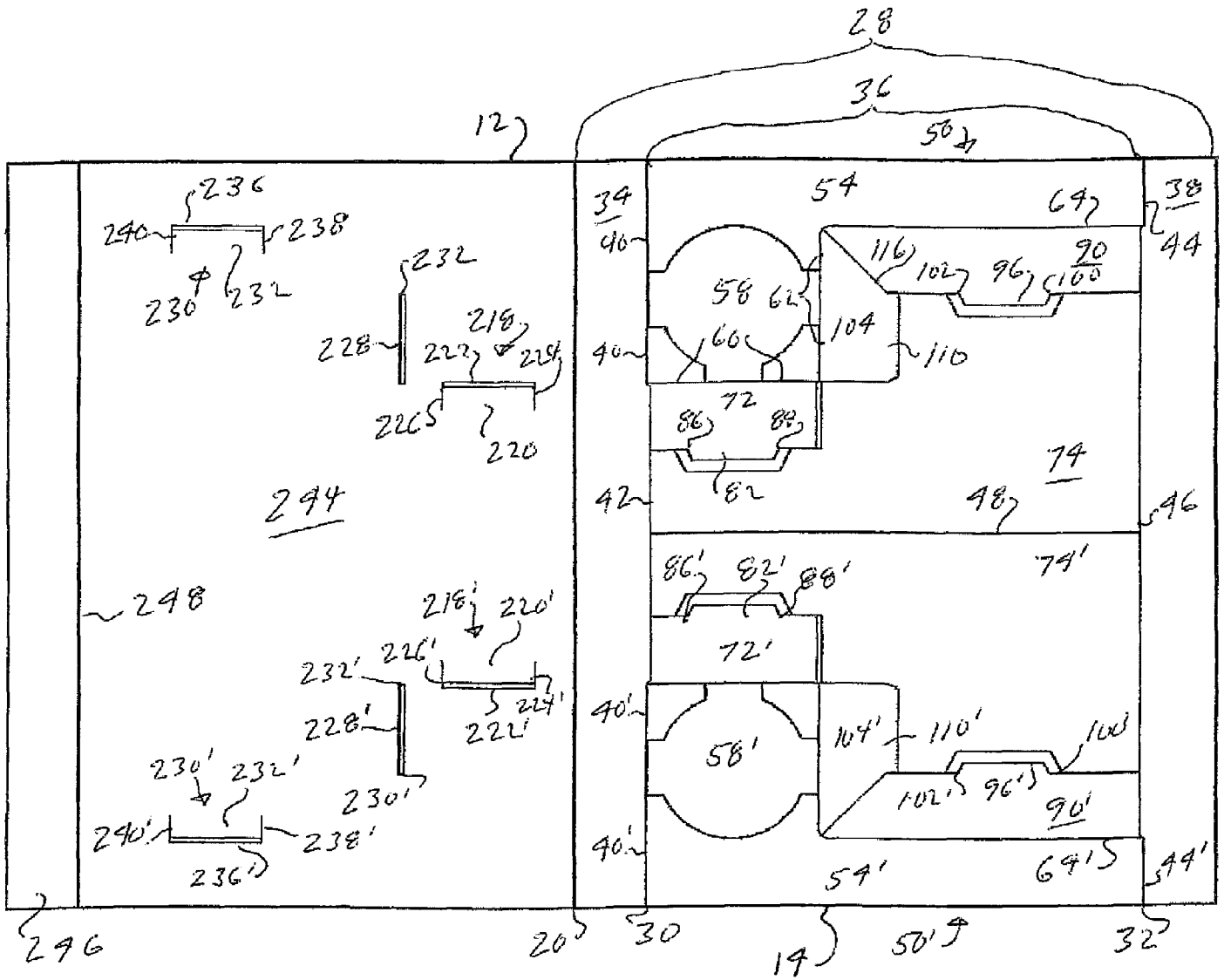
FIGS. 7-8 are top plan view of different embodiments of the blank for the tray.
Figure 8:
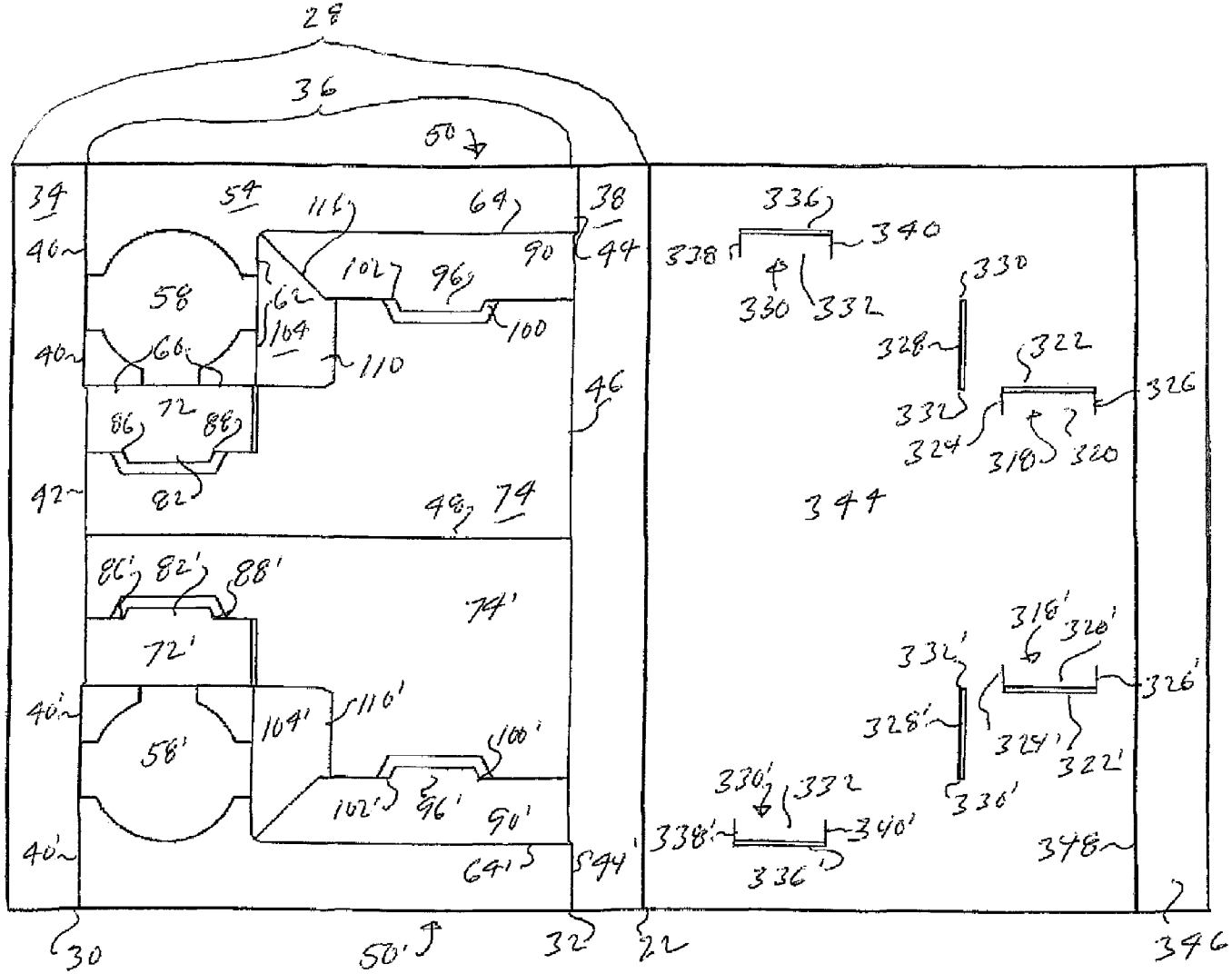

In the embodiments shown in FIGS. 7 and 8, the upper element 28 is the same as in FIG. 1 and the same reference numerals are used throughout.

The difference in the three embodiments is the bottom wall and its attachment to the upper element 28. In each of the embodiments the bottom wall has locking apertures which are aligned with inner panel locking tabs in the erected tray.

In FIG. 7 the bottom wall 244 is attached to the upper element 28 along transverse score line 20.

One of the locking apertures, first locking aperture 218, is for locking tab 82 on first inner panel 72. The aperture 218 may be a standard aperture, or, as shown, be formed by U-shaped slits to form a securing tab 220. The U-shaped slit 218 is formed by longitudinal slit 222 having a transverse slit 224 at one end and a transverse slit 226 at the other end. The longitudinal slit 222 is substantially aligned with score line 60. Transverse slit 224 is spaced from transverse score line 20 a distance that is equal to or slightly less than the distance between transverse line 30 and first side end 86 of locking tab 82. The distance between transverse slits 224 and 226 is equal to or slightly greater than the distance between the ends 86 and 88 of locking tab 82 to allow the locking tab 82 to extend through the locking aperture 218 in the formed tray. The slits 222, 224 and 226 form the securing tab 220 which pushes against and secures locking tab 82 in the formed tray. In the embodiment shown the transverse slits 224 and 226 extend inwardly from longitudinal slit 222 away from longitudinal side edge 12. They may also extend toward the side edge 12 instead of away from the side edge. In either direction they form the securing tab.

If there is no securing tab 220 then the aperture 218 would be formed by a second longitudinal line parallel to longitudinal slit 222 extending between the transverse slits 224 and 226 to form an aperture. The spacing of transverse slit 224 from transverse score line 20 and the distance between transverse score lines 224 and 226 would be the same as described in the previous paragraph.

The second of the pair of locking apertures, second locking aperture 228 is for locking tab 110 on second inner panel 104. Second locking aperture 228 is substantially parallel to score lines 20 and 62, and is spaced from score line 20 a distance that is substantially equal to the distance between transverse line 30 and score line 62. The length of locking aperture 228, defined by the distance between its ends 230 and 232 is substantially equal to or greater than the length of locking tab 110. The locking aperture 228 is aligned with locking tab 110 so that the locking tab 110 will lock within locking aperture 228 when the tray is erected.

Third locking aperture 230, is for locking tab 96 on third inner panel 90. The aperture 230 may be a standard aperture, or, as shown, be formed by U-shaped slits to form a securing tab 232. The U-shaped slit 234 is formed by longitudinal slit 236 having a transverse slit 238 at one end and a transverse slit 240 at the other end. The longitudinal slit 236 is aligned substantially with score line 64. Transverse slit 238 is spaced from transverse score line 20 a distance that is equal to or slightly less than the distance between transverse line 30 and first side end 102 of locking tab 96. The distance between transverse slits 238 and 240 is equal to or slightly greater than the distance between the ends 100 and 102 of locking tab 96 to allow the locking tab 96 to extend through the locking aperture 230 in the formed tray. The slits 220, 222 and 224 form a securing tab 232 which pushes against locking tab 96 in the formed tray. In the embodiment shown the transverse slits 238 and 240 extend inwardly from longitudinal slit 236 away from longitudinal side edge 12. They may also extend toward the side edge 12 instead of away from the side edge. In either direction they form the securing tab.

A similar set of locking apertures is at the other end of bottom wall 244.

First locking aperture 218' is for locking tab 82' on first inner panel 72'. The aperture 218' may be a standard aperture, or, as shown, be formed by U-shaped slits to form a securing tab 220'. The U-shaped slit 218' is formed by longitudinal slit 222' having a transverse slit 224' at one end and a transverse slit 226' at the other end. The longitudinal slit 222' is substantially aligned with score line 60'. Transverse slit 224' is spaced from transverse score line 20 a distance that is equal to or slightly less than the distance between transverse line 30 and first side end 86' of locking tab 82'. The distance between transverse slits 224' and 226' is equal to or slightly greater than the distance between the ends 86' and 88' of locking tab 82' to allow the locking tab 82' to extend through the locking aperture 218' in the formed tray. The slits 222', 224' and 226' form the securing tab 220' which pushes against and secures locking tab 82' in the formed tray. In the embodiment shown the transverse slits 224' and 226' extend inwardly from longitudinal slit 222' away from longitudinal side edge 14. They may also extend toward the side edge 14 instead of away from the side edge. In either direction they form the securing tab.

If there is no securing tab 220' then the aperture 218' would be formed by a second longitudinal line parallel to longitudinal slit 222' extending between the transverse slits 224' and 226' to form an aperture. The spacing of transverse slit 224' from transverse score line 20 and the distance between transverse score lines 224' and 226' would be the same as described in the previous paragraph.

Second locking aperture 228' is for locking tab 110' on second inner panel 104'. Second locking aperture 228' is substantially parallel to score lines 20 and 62', and is spaced from score line 20 a distance that is substantially equal to the distance between transverse line 30 and score line 62'. The length of locking aperture 228', defined by the distance between its ends 230' and 232' is substantially equal to or greater than the length of locking tab 110'. The locking aperture 228' is aligned with locking tab 110' so that the locking tab 110' will lock within locking aperture 228' when the tray is erected.

Third locking aperture 230', is for locking tab 96' on third inner panel 90'. The aperture 230' may be a standard aperture, or, as shown, be formed by U-shaped slits to form a securing tab 232'. The U-shaped slit 234' is formed by longitudinal slit 236' having a transverse slit 238' at one end and a transverse slit 240' at the other end. The longitudinal slit 236' is aligned substantially with score line 64'. Transverse slit 238' is spaced from transverse score line 20 a distance that is equal to or slightly less than the distance between transverse line 30 and first side end 102' of locking tab 96'. The distance between transverse slits 238' and 240' is equal to or slightly greater than the distance between the ends 100' and 102' of locking tab 96' to allow the locking tab 96' to extend through the locking aperture 230' in the formed tray. The slits 220', 222' and 224' form a securing tab 232' which pushes against locking tab 96' in the formed tray. In the embodiment shown the transverse slits 238' and 240' extend inwardly from longitudinal slit 236' away from longitudinal side edge 14. They may also extend toward the side edge 14 instead of away from the side edge. In either direction they form the securing tab.

A third side panel 246 is attached to bottom wall 244 by score line 248. In forming the glued lay-flat tray, the blank is either bent around transverse line 32 and transverse score line 20 or around transverse line 30 and score line 248, and third side panel 246 is glued to second side panel 38.

In FIG. 8 the bottom wall 344 is attached to the upper element 28 along transverse score line 22.

First locking aperture 318, is for locking tab 82 on first inner panel 72. The aperture 318 may be a standard aperture, or, as shown, be formed by U-shaped slits to form a securing tab 320. The U-shaped slit is formed by longitudinal slit 322 having a transverse slit 324 at one end and a transverse slit 326 at the other end. The longitudinal slit 322 is substantially aligned with score line 60. Transverse slit 324 is spaced from transverse score line 22 a distance that is equal to or slightly less than the distance between transverse line 32 and second side end 88 of locking tab 82. The distance between transverse slits 324 and 326 is equal to or slightly greater than the distance between the ends 86 and 88 of locking tab 82 to allow the locking tab 82 to extend through the locking aperture 318 in the formed tray. The slits 322, 324 and 326 form the securing tab 320 which pushes against and secures locking tab 82 in the formed tray. In the embodiment shown the transverse slits 324 and 326 extend inwardly from longitudinal slit 322 away from longitudinal side edge 12. They may also extend toward the side edge 12 instead of away from the side edge. In either direction they form the securing tab.

If there is no securing tab 320 then the aperture 318 would be formed by a second longitudinal line parallel to longitudinal slit 322 extending between the transverse slits 324 and 326 to form an aperture. The spacing of transverse slit 324 from transverse score line 22 and the distance between transverse score lines 324 and 326 would be the same as described in the previous paragraph.

Second locking aperture 328 is for locking tab 110 on second inner panel 104. Second locking aperture 328 is substantially parallel to score lines 22 and 62, and is spaced from score line 22 a distance that is substantially equal to the distance between transverse line 32 and score line 62. The length of locking aperture 328, defined by the distance between its ends 330 and 332 is substantially equal to or greater than the length of locking tab 110. The locking aperture 328 is aligned with locking tab 110 so that the locking tab 110 will lock within locking aperture 328 when the tray is erected.

Third locking aperture 330, is for locking tab 96 on third inner panel 90. The aperture 330 may be a standard aperture, or, as shown, be formed by U-shaped slits to form a securing tab 332. The U-shaped slit 334 is formed by longitudinal slit 336 having a transverse slit 338 at one end and a transverse slit 340 at the other end. The longitudinal slit 336 is aligned substantially with score line 64. Transverse slit 338 is spaced from transverse score line 22 a distance that is equal to or slightly less than the distance between transverse line 32 and second side end 100 of locking tab 96. The distance between transverse slits 338 and 340 is equal to or slightly greater than the distance between the ends 100 and 102 of locking tab 96 to allow the locking tab 96 to extend through the locking aperture 330 in the formed tray. The slits 320, 322 and 324 form a securing tab 332 which pushes against locking tab 96 in the formed tray. In the embodiment shown the transverse slits 338 and 340 extend inwardly from longitudinal slit 336 away from longitudinal side edge 12. They may also extend toward the side edge 12 instead of away from the side edge. In either direction they form the securing tab.

A similar set of locking apertures is at the other end of bottom wall 344.

First locking aperture 318' is for locking tab 82' on first inner panel 72'. The aperture 318' may be a standard aperture, or, as shown, be formed by U-shaped slits to form a securing tab 320'. The U-shaped slit is formed by longitudinal slit 322' having a transverse slit 324' at one end and a transverse slit 326' at the other end. The longitudinal slit 322' is substantially aligned with score line 60'. Transverse slit 324' is spaced from transverse score line 22 a distance that is equal to or slightly less than the distance between transverse line 30 and second side end 88' of locking tab 82'. The distance between transverse slits 324' and 326' is equal to or slightly greater than the distance between the ends 86' and 88' of locking tab 82' to allow the locking tab 82' to extend through the locking aperture 218' in the formed tray. The slits 322', 324' and 326' form the securing tab 320' which pushes against and secures locking tab 82' in the formed tray. In the embodiment shown the transverse slits 324' and 326' extend inwardly from longitudinal slit 322' away from longitudinal side edge 14. They may also extend toward the side edge 14 instead of away from the side edge. In either direction they form the securing tab.

If there is no securing tab 320' then the aperture 318' would be formed by a second longitudinal line parallel to longitudinal slit 322' extending between the transverse slits 324' and 326' to form an aperture. The spacing of transverse slit 324' from transverse score line 20 and the distance between transverse score lines 324' and 326' would be the same as described in the previous paragraph.

Second locking aperture 328' is for locking tab 110' on second inner panel 104'. Second locking aperture 328' is substantially parallel to score lines 22 and 62', and is spaced from score line 22 a distance that is substantially equal to the distance between transverse line 32 and score line 62'. The length of locking aperture 328', defined by the distance between its ends 330' and 332' is substantially equal to or greater than the length of locking tab 110'. The locking aperture 328' is aligned with locking tab 110' so that the locking tab 110' will lock within locking aperture 328' when the tray is erected.

Third locking aperture 330', is for locking tab 96' on third inner panel 90'. The aperture 330' may be a standard aperture, or, as shown, be formed by U-shaped slits to form a securing tab 332'. The U-shaped slit 334' is formed by longitudinal slit 336' having a transverse slit 338' at one end and a transverse slit 340' at the other end. The longitudinal slit 336' is aligned substantially with score line 64'. Transverse slit 338' is spaced from transverse score line 22 a distance that is equal to or slightly less than the distance between transverse line 32 and second side end 100' of locking tab 96'. The distance between transverse slits 338' and 340' is equal to or slightly greater than the distance between the ends 100' and 102' of locking tab 96' to allow the locking tab 96' to extend through the locking aperture 230' in the formed tray. The slits 320', 322' and 324' form a securing tab 332' which pushes against locking tab 96' in the formed tray. In the embodiment shown the transverse slits 338' and 340' extend inwardly from longitudinal slit 336' away from longitudinal side edge 14. They may also extend toward the side edge 14 instead of away from the side edge. In either direction they form the securing tab.

A third side panel 346 is attached to bottom wall 344 by score line 348. In forming the glued lay-flat tray, the blank is either bent around transverse line 32 and transverse score line 20 or around transverse line 30 and score line 348, and third side panel 346 is glued to first side panel 34.

In the embodiments shown, both extensions 56 and 56' and the associated apertures 58 and 58', and the associated first inner panels 72 and 72' are shown adjacent transverse line 30. In another embodiment, the L-shaped upper walls may be in opposed directions placing cup apertures 58 and 58' in opposed corners so that one cup aperture and its first inner panel is adjacent transverse line 30 and the other cup aperture and its first inner panel is adjacent transverse line 32. The relationship of all the elements of upper member would be the same. One set of locking elements on the outer bottom wall would be reversed to accommodate the reversed locking tabs.

In another set of embodiments, the inner bottom walls 74 and 74' would be eliminated from each of the embodiments shown in FIGS. 1, 7 and 8.

While embodiments of the invention has been illustrated and described, it will be appreciated that various changes can be made therein without departing from the spirit and scope of the invention.

The embodiments of the invention in which an exclusive property or privilege is claimed are defined as follows:

1. A tray blank comprising an L-shaped upper wall defined by an outer edge, first and second side edges, and first, second and third inner edges, the first and second side edges being transverse to the outer edge, the first and third inner edges being transverse to the first and second side edges, and extending inwardly respectively from the first and second side edges, the first inner edge having an inner end spaced from the first side edge, the third inner edge having an inner end spaced from the second side edge, the first inner edge being spaced further from the outer edge than the third inner edge, the second inner edge extending between the inner ends of the first and third inner edges, first, second and third inner panels attached to the first, second and third inner edges, respectively, the first, second and third inner edges being formed by score lines between the L-shaped upper wall and the first, second and third inner panels, each of the inner panels having a bottom edge opposite the score line attaching the panel to the upper wall, each of the inner panels having a locking tab on its bottom edge, each of the locking tabs having a length, a first side panel attached to the first side edge of the upper wall, the first side edge of the upper wall being formed by a score line between the upper wall and the first side panel, a second side panel attached to the second side edge of the upper wall, the second side edge of the upper wall being formed by a score line between the upper wall and the second side panel, each of the side panels having an edge opposite the side panels attachment to the upper wall, a bottom wall element attached to an opposite edge of at least one of the side panels, the bottom wall element having locking apertures that align with the locking tabs in the erected tray, each of the locking apertures having a length that is at least as long as the length of its associated locking tab.

2. The blank of claim 1 wherein the locking aperture associated with the locking tab on the first inner panel is aligned with the first inner edge of the upper wall, the locking aperture associated with the locking tab on the third inner panel is aligned with the third inner edge on the upper wall, and the locking aperture associated with the locking tab on the second inner panel is spaced from the opposite end of the side panel to which the bottom wall element is attached a distance equal to the distance between the second inner side edge of the upper wall and the side edge of the upper panel to which the same side panel is attached.

3. The blank of claim 1 in which the side panels and the inner panels are of substantially the same height.

4. The blank of claim 3 further comprising an inner bottom wall attached to the bottom edges of the first and third inner panels, the bottom edge of the first inner panel being formed by score line between the inner bottom wall and the first inner panel, the bottom edge of the third inner panel being formed by score line between the inner bottom wall arid the third inner panel, the inner bottom wall being separated from the side panels by slits or perforations.

5. The blank of claim 1 wherein the bottom wall element is attached to the opposite edge of the first side panel, the opposite edge of the first side panel being formed by the score line between the bottom wall element and the first side panel, the blank further comprising a second bottom wall element attached to the opposite edge of the second side panel, the opposite edge of the second side panel being formed by the score line between the other bottom wall element and the second side panel, each of the bottom wall elements having an edge opposite the bottom wall element's attachment to its side panel, the width of each bottom wall element being the distance between the bottom wall element's attachment to the side panel and the bottom wall element's opposite edge, the combined width of the bottom wall elements being greater than the distance between the side edges of the upper wall.

6. The blank of claim 1 wherein the bottom wall element is attached only to the opposite edge of the first side panel.

7. The blank of claim 1 wherein the bottom wall element is attached only to the opposite edge of the second side panel.

* * * * *